US007431646B2

(12) United States Patent
Jackson

(10) Patent No.: US 7,431,646 B2
(45) Date of Patent: Oct. 7, 2008

(54) GRID-BASED AWARD METHOD FOR BASE GAME AND BONUS TOP BOX GAME FOR USE WITH VIDEO WAGERING MACHINES OR SLOT-TYPE MACHINES

(75) Inventor: Kathleen Nylund Jackson, Scituate, MA (US)

(73) Assignee: Precedent Gaming, Incorporated, Scituate, MA (US)

( * ) Notice: Subject to any disclaimer, the term of this patent is extended or adjusted under 35 U.S.C. 154(b) by 696 days.

(21) Appl. No.: 11/121,683

(22) Filed: May 4, 2005

(65) Prior Publication Data

US 2005/0255903 A1 Nov. 17, 2005

(51) Int. Cl.
*A63F 9/24* (2006.01)

(52) U.S. Cl. ..... 463/16

(58) Field of Classification Search ..... None
See application file for complete search history.

(56) References Cited

U.S. PATENT DOCUMENTS

| | | | | |
|---|---|---|---|---|
| 6,089,977 | A * | 7/2000 | Bennett | 463/20 |
| 6,203,427 | B1 | 3/2001 | Walker et al. | 463/16 |
| 6,290,600 | B1 * | 9/2001 | Glasson | 463/20 |
| 6,517,432 | B1 * | 2/2003 | Jaffe | 463/16 |
| 6,561,900 | B1 * | 5/2003 | Baerlocher et al. | 463/20 |
| 6,634,945 | B2 | 10/2003 | Glavich et al. | 463/20 |
| 6,682,419 | B2 | 1/2004 | Webb et al. | 463/16 |
| 6,682,420 | B2 | 1/2004 | Webb et al. | 463/16 |
| 2003/0045345 | A1 | 3/2003 | Berman | 463/20 |
| 2004/0023708 | A1 | 2/2004 | Kaminkow et al. | 463/16 |
| 2004/0043809 | A1 | 3/2004 | Gomez et al. | 463/16 |
| 2004/0053679 | A1 | 3/2004 | Getz et al. | 463/20 |

OTHER PUBLICATIONS

"Dots and Boxes", http://en.wikipedia.org/wiki/Dots_and _Boxes, Jul. 2000 Article Attached.*

Dots and Boxes online game, http://www.math.ucla.edu/~tom/Games/dots&boxes.html, Feb. 14, 2004.*

Peterson, Ivars, "Dots and Boxes", http://www.maa.org/mathland/mathtrek_10_30_00.html, Oct. 30, 2000 Article Attached.*

* cited by examiner

*Primary Examiner*—Ronald Laneau
*Assistant Examiner*—Tramar Harper
(74) *Attorney, Agent, or Firm*—Mark A. Litman & Associates, P.A.

(57) ABSTRACT

An apparatus that enables a gaming method and the gaming method of playing a wagering game comprises providing a gaming display area including game areas that may be indicated as enclosed by edge features. Edge features are positioned on the gaming display area. Positioning of edge features is then ceased according to rules of the wagering game to a final count of edge features. After the final count of edge features has been deposited and symbols are present on the display area, it is determined if the edge features enclose symbols according to rules of the wagering game. It is then determined if any symbols enclosed by edge features according to the rules of the game establish a winning event, losing event or push event in the game.

14 Claims, 11 Drawing Sheets

GRID-BASED AWARD METHOD FOR BASE GAME AND BONUS TOP BOX GAME FOR USE WITH VIDEO WAGERING MACHINES OR SLOT-TYPE MACHINES

BACKGROUND OF THE INVENTION

1. Field of the Invention

The present invention relates to casino gaming, particularly methods of providing award features and award methods for slot-type wagering machines and video wagering machine base games and slot machine and video gaming machine bonus top box games, wherein the player may win from zero or one to a maximum number of awards in one game or bonus event.

2. Background of the Art

Competition in the gaming industry to attract a player and then retain the player's interest for protracted periods of time is an increasingly greater challenge. The environment in a casino is typically rich in stimulation, both visual and auditory. As a consequence, there is an ongoing effort to initially attract a player to a given machine and then to subsequently encourage the player to stay at the machine based on the machine's entertainment value. In addition to providing a fun and attractive base game, more and more casinos are looking for additive games or bonus games that are typically played on a separate device atop the base machine. The separate device is often attached to or associated with (e.g., a common plasma screen over a bank of slot machines) a base gaming apparatus (herein referred to generally as a "slot machine" which covers traditional slot-type games and machines, poker-type machines, video gaming machines and combinations thereof) and a "top box" game in which a game award or function or activity is displayed on a unit (referred to as the top box) that is usually elevated in view over the base gaming machine. These bonus games appeal not only to the player, but also draw the attention of passers-by, who may stop and play vicariously along with the player seated at the machine, or sit down at the machine or an adjacent machine of a similar format and place wagers to play themselves.

Slot machines formed from a plurality of reels that rotate independently of each other, whether mechanical or video depictions of the mechanical reels, are some of the oldest type of games. Each physical reel usually has a reel strip. On each strip are designated indicia. When predetermined indicia or predetermined sets or combinations of indicia or symbols, and especially related indicia are oriented on one or more "pay lines" that corresponds to the symbols or predetermined sets of symbols, an associated pay table is displayed elsewhere on the machines, and the player receives awards.

Such machines have evolved from having a single horizontal pay line centrally disposed on the reel to having a plurality of pay lines, some pay lines located horizontally, some diagonally, others vertically, some in corners and some in non-linear patterns. Even "scatter pays" are used, where the appearance of certain symbols anywhere on a screen provides an award, irrespective of their position. With the advent of video capability, additional methods have been implemented to provide alternate entertainment and maintain player enjoyment. There are many examples of different game and top box formats of play on slot machines.

U.S. Patent Application 20030045345 GAMING METHOD AND APPARATUS IMPLEMENTING A HIERARCHICAL DISPLAY GRID AND DYNAMICALLY GENERATED PAYLINES describes multiple display segments that form a dynamic payline when a predetermined number of display segments or subsegments are adjacent.

U.S. Patent Application 20040043809 CHAIN REACTION GAME (DeMar) describes a system where indicia are randomly shown on a grid. Matching symbols (at least 3 in a row, for example) are highlighted by machine, and paid off according to a paytable. The matching symbols then disappear, and remaining symbols are redistributed. For instance, all remaining symbols would "fall" towards bottom of grid in a manner similar to the non-wagering video game of Tetris® video games. New arrangements of symbols are then reevaluated. Play continues if there is a win, with elements yet again rearranging. The game ends when no more winning combinations are provided during play.

U.S. Patent Application 20040053679 GAMING MACHINE AND METHOD HAVING A BONUS GAME describes a base game and bonus game. A triggering event in base game is required to gain entry into a bonus game.

U.S. Patent Application 20040023708 GAMING DEVICE HAVING A MASKED AWARD GAME describes a grid with plurality of segments. Grid segments are defined by a plurality of independently selectable $1^{st}$ and $2^{nd}$ coordinates. For example, picking Column 4 (out of 6) and Row C (out of A-F), provides the prize in grid 4C.

U.S. Pat. No. 6,203,427 METHOD AND APPARATUS FOR SECURING A COMPUTER-BASED GAME OF CHANCE describes a game system for internet use. The player buys a virtual punch-card having a grid with prizes. The player picks a location, encrypts a code for that location, and then finds out if the game play was a win.

U.S. Pat. Nos. 6,682,420 and 6,682,419 GAMING DEVICE HAVING A PRIMARY GAME SCHEME INVOLVING A SYMBOL GENERATOR AND SECONDARY AWARD TRIGGERING GAMES describes a gaming system that provides one or more symbol generators and one or more secondary games. After at least one certain symbol is generated, the gaming device then operates one or more secondary games. The player is given an award if the player achieves a win in this secondary game(s).

U.S. Pat. No. 6,634,945 GAMING DEVICE HAVING INDEPENDENT BONUS REELS provides reels that spin and one wheel that stops randomly. The player gets an award or termination symbol which deactivates that reel. The player continues spinning and respinning until all reels have deactivated.

There is always a desire to develop new games with different programs and displays that provide additional player entertainment. This could be achieved by a stimulating secondary bonus game display, which would attract players with familiar reels, lights and sound, but that would also provide a unique, exciting gaming experience.

SUMMARY OF THE INVENTION

At least two related formats of play are provided in a wagering game, including physical slots, video slot-type systems, or combinations of the two systems. In a first format, a series of available positions or areas having symbols thereon are provided to a player. A program provides "edge features" that attempt to define a closing area around at least some of the symbols. The enclosed symbols are used to define or test for the basis of an award in the play of the game. In a second format, the edge features are provided to a non-active screen or reel set, and the enclosed areas are defined (or shown to be absent). The symbols are then randomly provided to the screen to provide active symbols. Those symbols that appear within the enclosed areas are used to define or test for the basis of an award in the play of the game. Conventional symbols, non-standard symbols, wild symbols, special award symbols and/or the like may be used as the symbols.

DETAILED DESCRIPTION OF THE INVENTION

Figure 1:
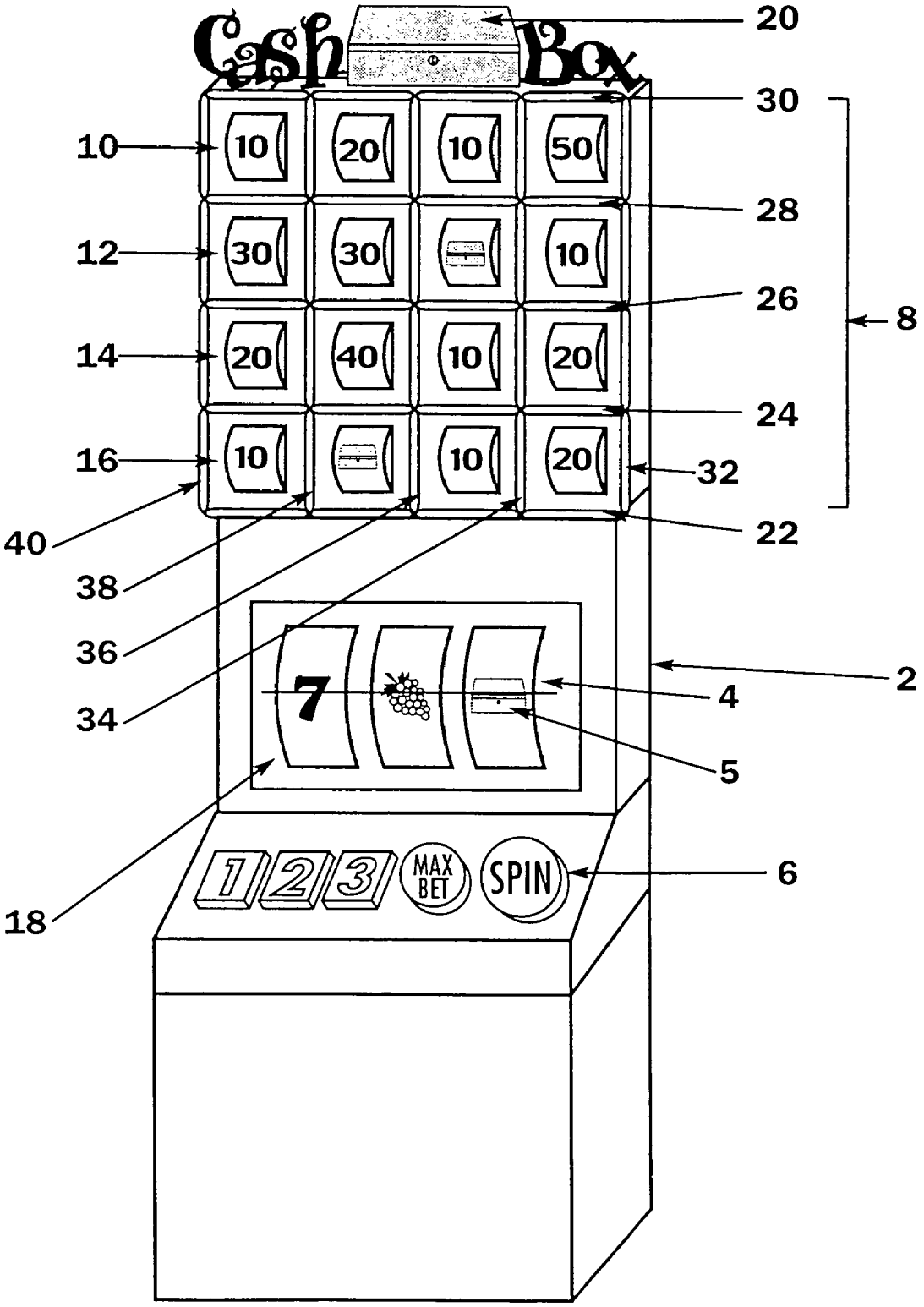
FIG. 1 shows a slot machine housing, wagering buttons, monitor with screen, and a 3-reel base game format with bonus game trigger on the third reel, a bonus top box game with 16 separate reels, horizontal and vertical light segments surrounding each reel, and a physical "Cash Box" symbol atop the bonus display.

A plurality of areas is provided on a video screen. These areas may be any defining or predetermined area on a screen, such as contiguous, adjacent, attached, or otherwise physically related (without a game effective barrier between the areas) areas, zones or regions. These areas are provided with one or more symbol(s) within each area, zone or region (hereinafter generally referred to as areas). The areas may be initially active in the next play of the game on the screen or inactive. For example, the areas may have symbols therein before play of the game is initiated that will remain in the play of the next game, or upon initiation of play of the game, the symbols in the areas will change then or at a later stage of play. Random edge defining features are inserted or otherwise placed on the screen to identify an edge that separates two areas and/or defines an exterior edge on the play area of the screen. It is usually desired that at least one and preferably a plurality of areas are enclosed by the edge defining features, identifying symbols or specific awards that are in play or are to be awarded. However, in the play of certain variations of the general game described herein, conclusion of a round of play may result in no areas being fully enclosed, as described herein. The areas on the screen may be standard or non-standard areas on a video gaming screen such as frames, pay lines, patterned arrays of symbols or unpatterned symbols on a screen. The areas do not have to be obviously defined on the screen at the beginning of the game, as the areas may be image space around symbols that are provided over the screen. For example, the screen may show an assortment of farm animals (stationary or wandering around a barnyard), each symbol tending to maintain its individual space, at least upon resolution of the game. The areas may be defined by fences being constructed by random placement of fence posts and connections around the barnyard and eventually around the animals. A more common example of areas would be squares, rectangles or boxes that are connected by common edge ("side") segments, creating a standard grid as appears in many video wagering games. The edge features may then be randomly inserted to form random placements or patterns of top sides, left sides, bottom sides and right sides. These placements of edge features can be most easily used in the square, rectangle or box format to define enclosed areas. Circles, triangles, ovals, or irregular geometric shapes can also be used as the areas and other linear or non-linear forms can be used to define the edge features to surround or enclose those areas or symbols. When edge feature positioning is completed (according to the rules of play), there will be, inside at least some if not each resulting square of the grid, a symbol, blank, words, value, icon or other identifier (including wild symbols or event symbols, hereinafter generally referred to as a "symbol"). These symbols may be displayed on either a physical or virtual reel, with special edge features required in combination with physical reels (e.g., electric lights, such as bulbs or LED lights along edges framing each reel position). Once the symbols have been displayed on the areas on the screen (such as frames on the screen), as by the reels having been spun and stopped, at least a minimum number of individual side segments are provided that under the rules of the game may fully enclose a symbol, placing that symbol into play in the game. With standard rows and columns of symbols as an example, vertical or horizontal side segments are placed, highlighted or lit up one at a time, randomly or seemingly randomly, until the play of the game is completed. Play may or may not enclose any symbols (a loss) or may be required (especially in bonus play) to enclose at least one symbol to provide an award. In one example, a plurality of adjoining (non-parallel) segments form a distinct closed path, enclosure or fence around one or up to a maximum number of symbols. As soon as the first closed path is identified, it is one format of the play that no more segments are lit up (although multiple enclosures may be allowed in the play of the game, up to including all frames or areas). The path or enclosure may then be illuminated or otherwise distinguished by new color lights, flashing lights or the like to emphasize where the winning symbols are found on the screen. Any symbols inside the enclosed area are then evaluated for a win according to a predetermined pay table, or by adding up all the enclosed values. A special symbol appearing in the enclosed area may determine an extra bonus award, multiplier or an absolute value.

Reference to the figures will provide additional insight and additional enablement into the play of games described herein.

FIG. 1 shows a slot machine housing 2, wagering buttons 6, monitor with screen 18 and a 3-reel base game format 4 with bonus game trigger 5 on the third reel, a bonus top box game 8 with 16 separate reels (shown here in a first row of 4 reels 10, a second row of 4 reels 12, a third row of 4 reels 14 and a fourth row of 4 reels 16), horizontal light segments 22, 24, 26, 28 and 30 and vertical light segments 32, 34, 36, 38 and 40 surrounding each reel, and a physical "Cash Box" symbol 20 atop the bonus display 8.

Figure 1A:
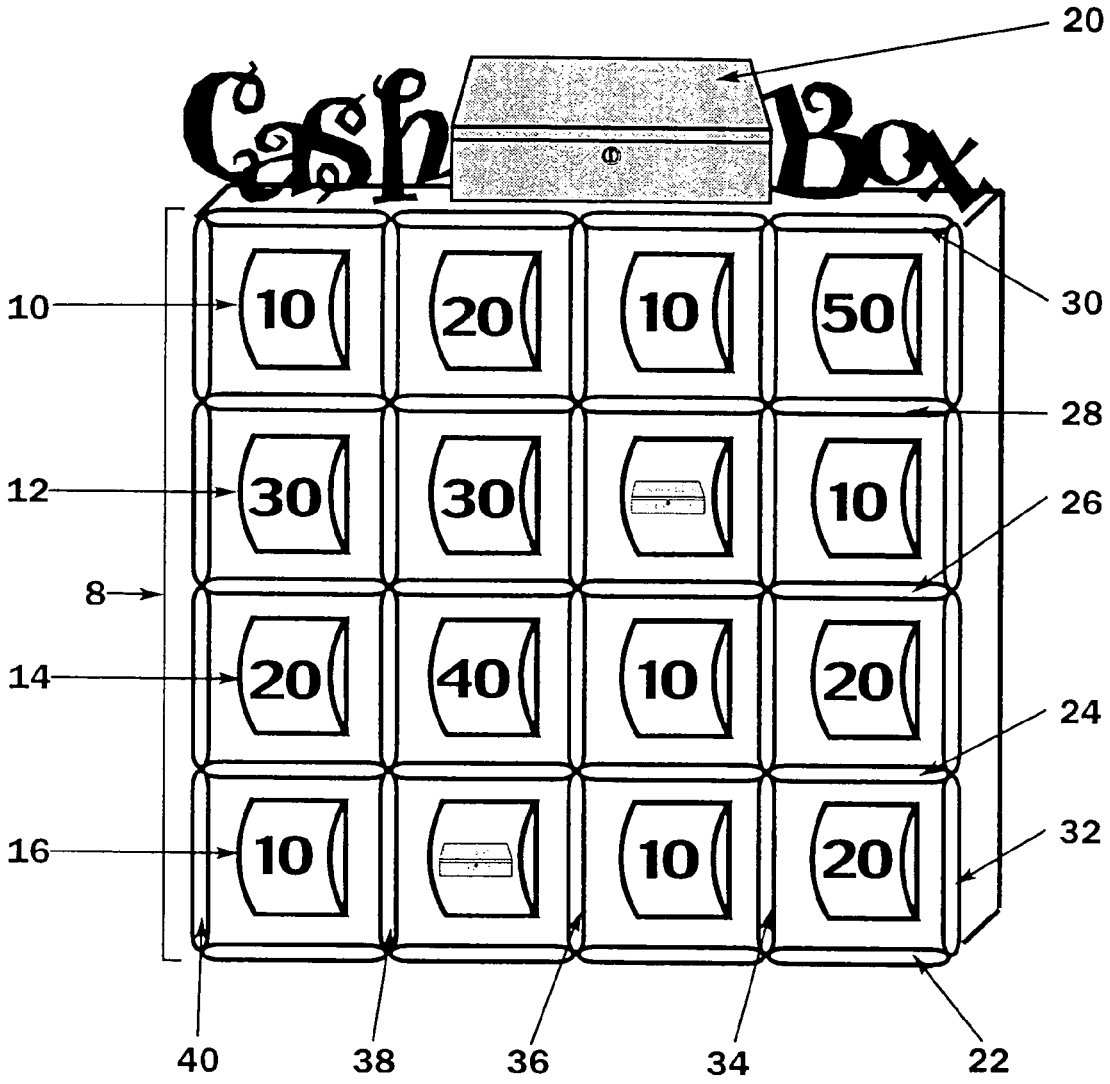
FIG. 1A shows the bonus top box game before activation of the bonus game.

FIG. 1A shows the bonus top box game 8 before activation of the bonus game. The symbols shown on reels 10, 12, 14 and 16 may or may not be used in the play of the next game. For purposes of explanation, it will be assumed that the symbols shown have not been reset (these are the symbols spun in the previous game) and the bonus game is ready to play with those symbols being replaced in a first step. Symbol positions may be carried from game to game or replaced according to varying rules of play designed into the game, and may even be respun by players prior to playing the game at their control.

Figure 2:
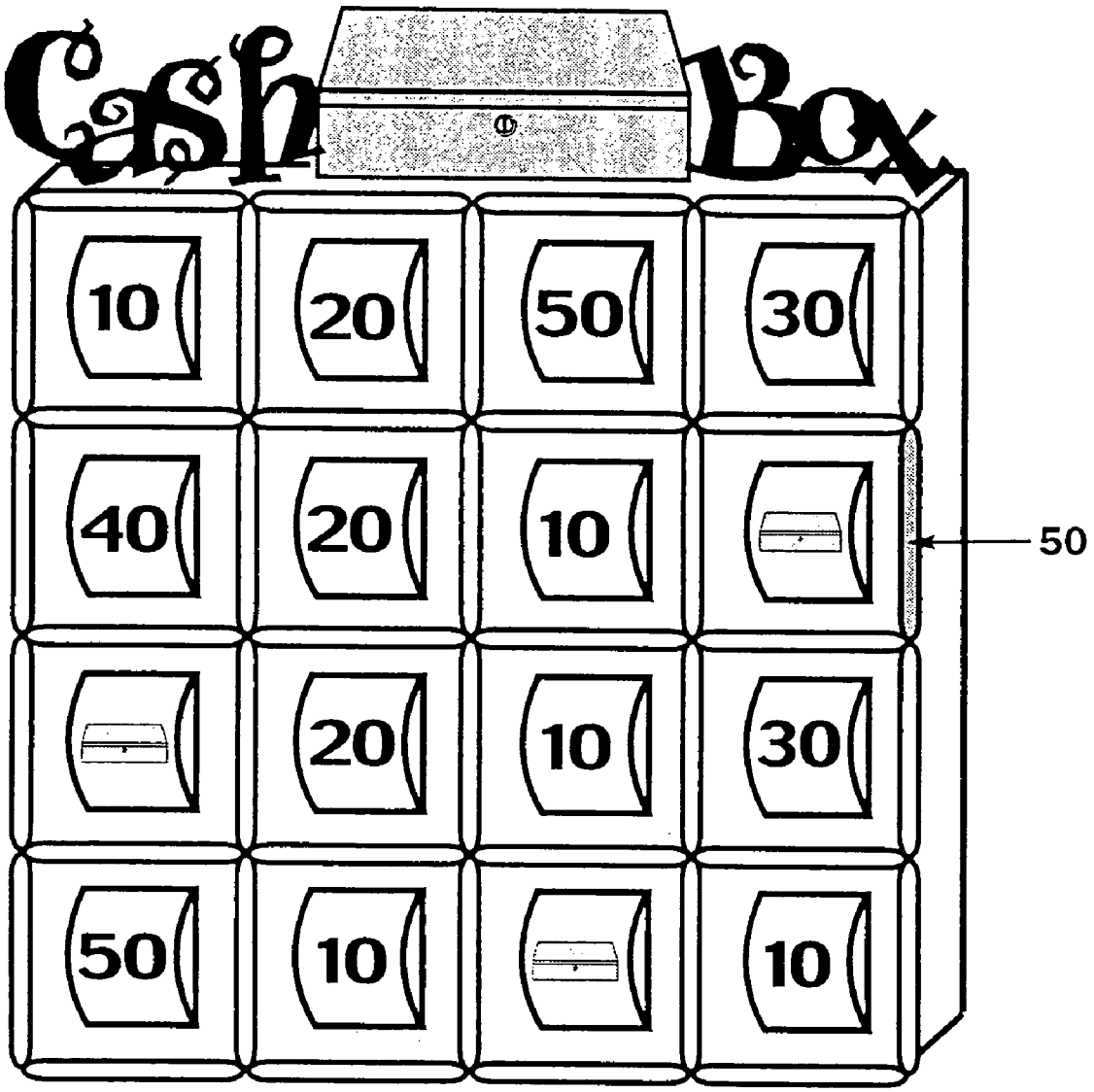
FIG. 2 shows the bonus top box game after all 16 reels have spun and stopped, and a first side segment has "randomly" been highlighted.

FIG. 2 shows the bonus top box game after all 16 reels have spun and stopped, and a first side segment 50 has "randomly" been highlighted. The position of the edge feature 50 placement can be determined by, for example, a random number generator, with each edge feature having been usually given at least one identifying number, and then conventional or non-conventional random number generation being used to select numbers identifying the edge features according to rules of the game.

Figure 3:
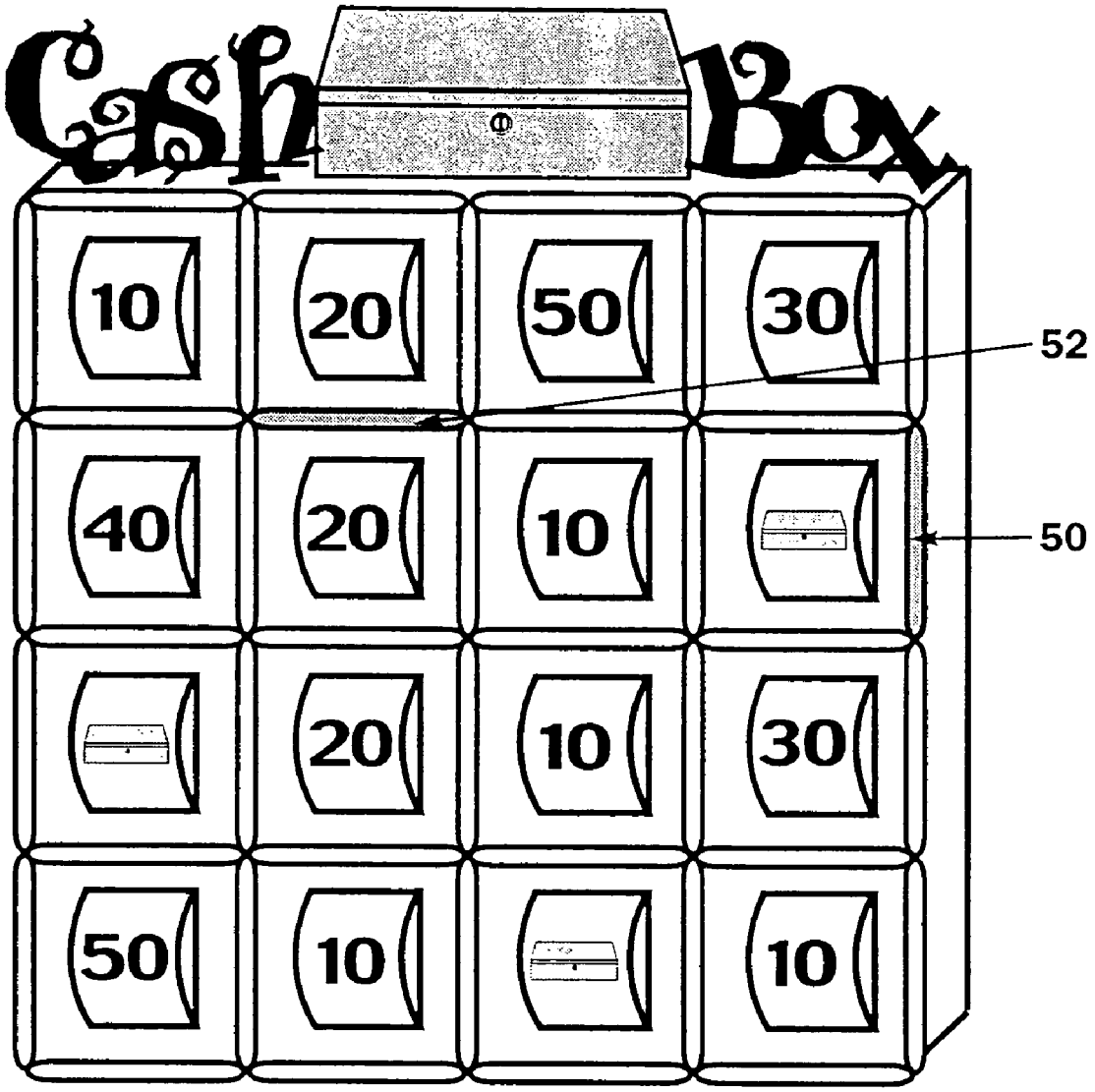
FIG. 3 shows the bonus top box game with the first side segment and a second side segment "randomly" highlighted.

FIG. 3 shows the bonus top box game with the first side segment 50 and a second side segment 50 "randomly" highlighted, that is, highlighted after having been randomly or seemingly randomly selected.

Figure 4:
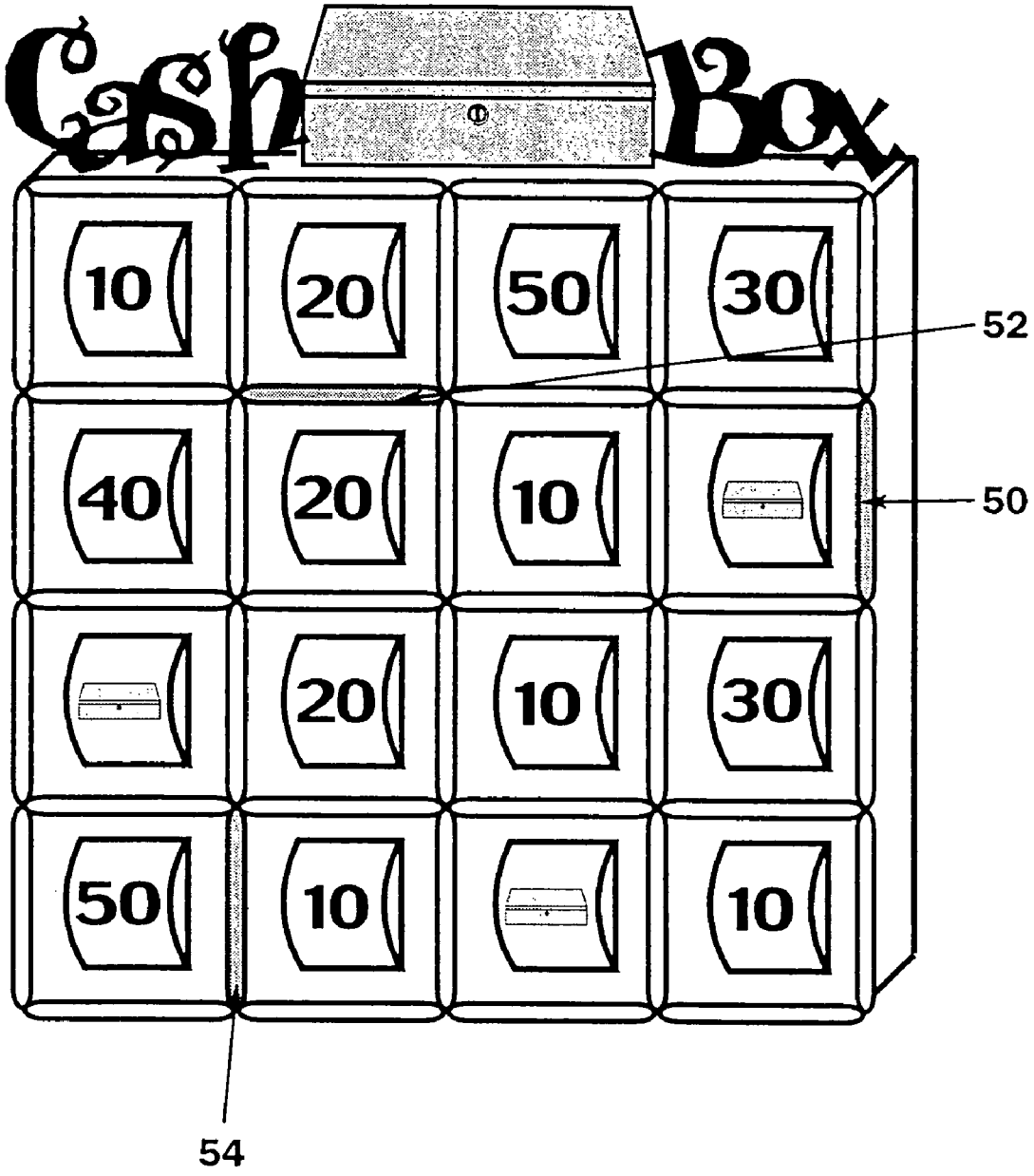
FIG. 4 shows the bonus top box game with the first side segment, the second side segment, and a third side segment "randomly" highlighted.

FIG. 4 shows the bonus top box game with the first side segment 50, the second side segment 52 and a third side segment 54 "randomly" highlighted.

Figure 5:
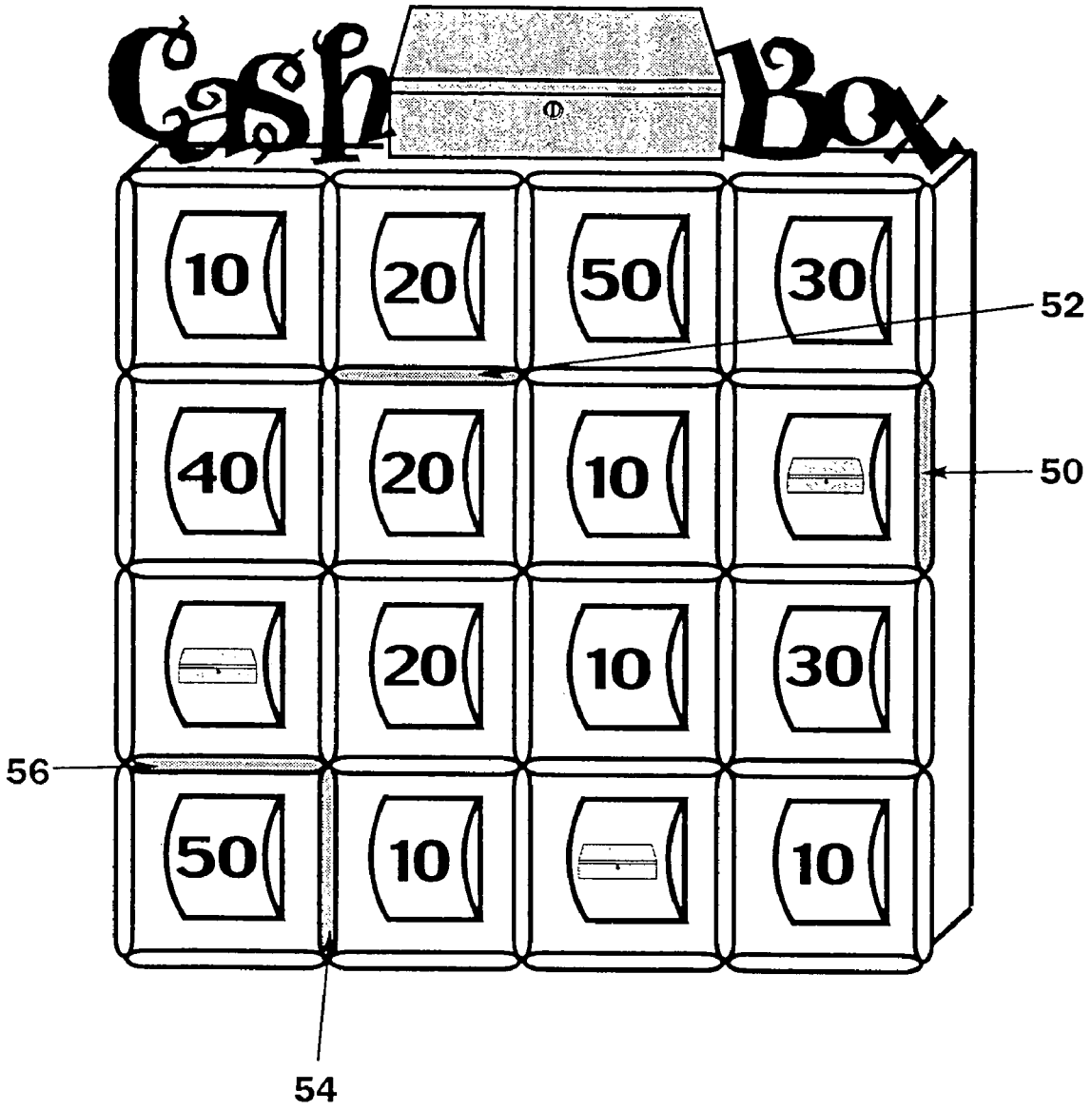
FIG. 5 shows the bonus top box game with the first side segment, the second side segment, the third side segment, and a fourth side segment "randomly" highlighted.

FIG. 5 shows the bonus top box game with the first side segment 50, the second side segment 52, the third side segment 54 and a fourth side segment 56 "randomly" highlighted. It is to be noted that a value of "50" is partially enclosed by edge features 54 and 56. This may or may not, according to the rules of the game, make this value activated for play of the game, or the rules may require that two more edge features fully enclose the symbol "50" for it to be in play.

Figure 6:
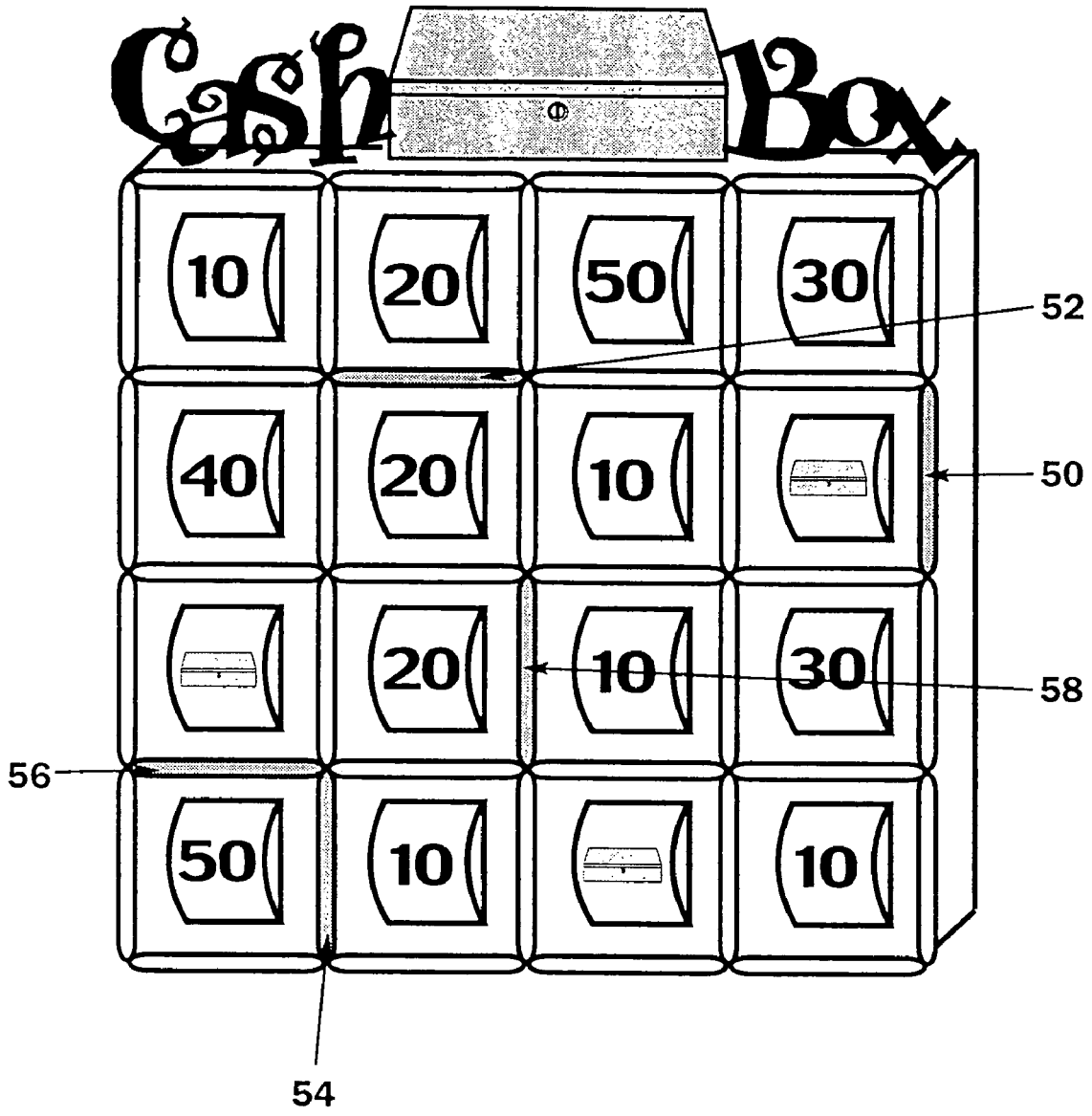
FIG. 6 shows the bonus top box game with the first side segment, the second side segment, the third side segment, the fourth side segment, and a fifth side segment "randomly" highlighted.

FIG. 6 shows the bonus top box game with the first side segment 50, the second side segment 52, the third side segment 54, the fourth side segment 56 and a fifth side segment 58 "randomly" highlighted.

Figure 7:
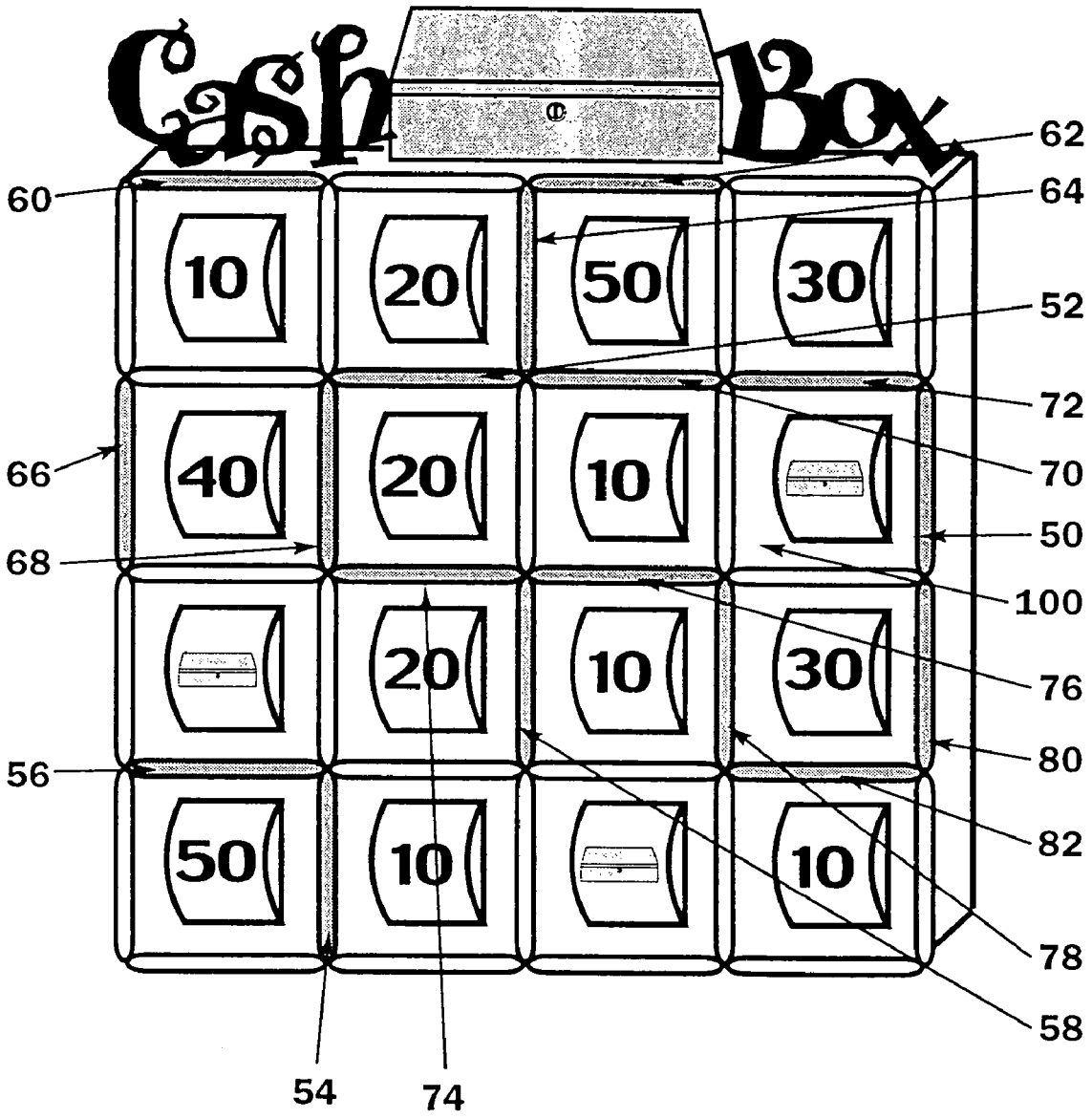
FIG. 7 shows the bonus top box game with additional segments having been added one by one until an enclosed area is determined.

FIG. 7 shows the bonus top box game with additional segments 60, 62, 64, 66, 68, 70, 72, 74, 76, 78, 80 and 82 having been added one by one until an enclosed area 100 is determined.

Figure 8:
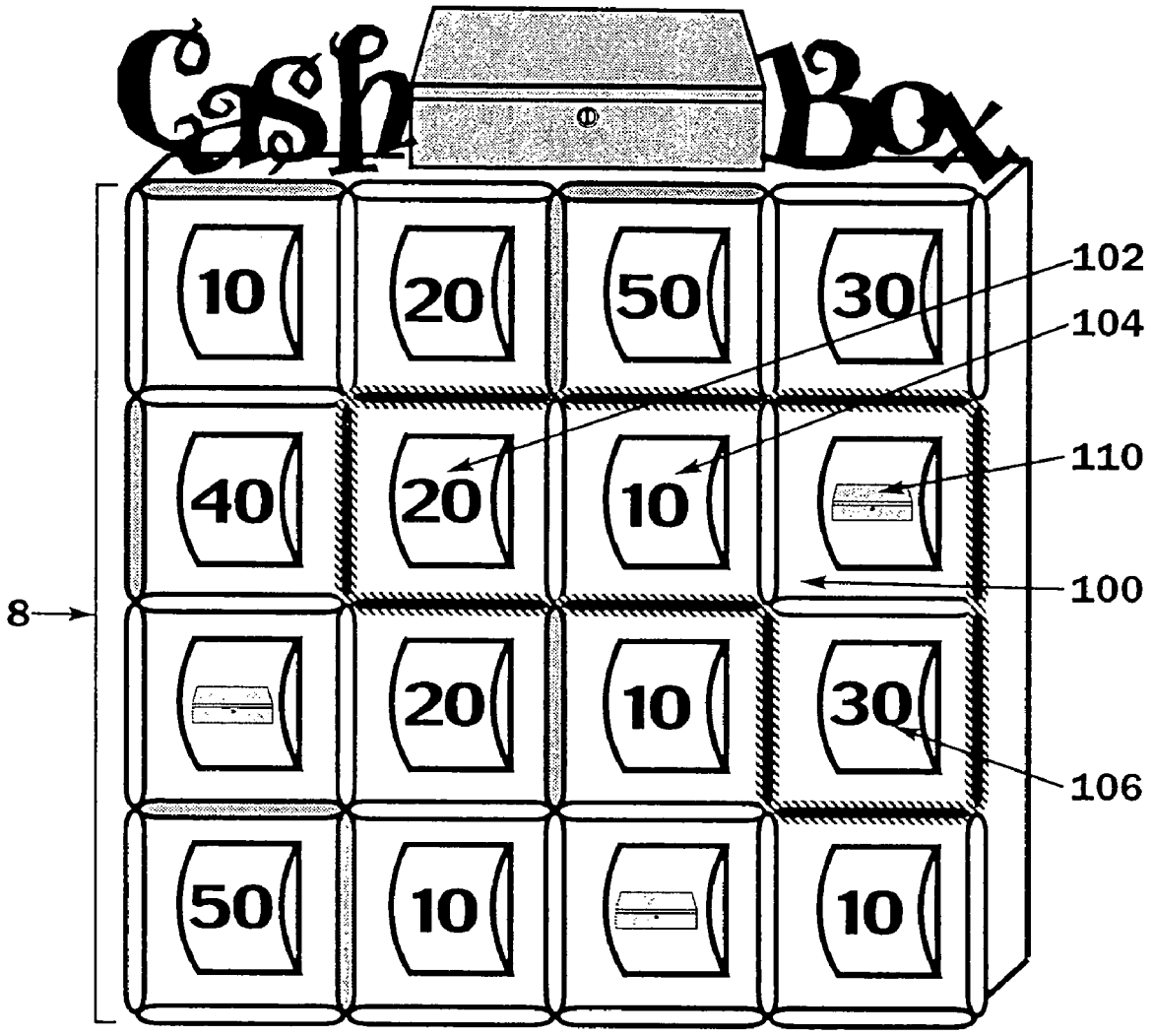
FIG. 8 shows the bonus top box game with the enclosed area highlighted in a different color to further distinguish the enclosure, and the winning values of 20, 10, 30, and one special Cash Box symbol.

FIG. 8 shows the bonus top box game 8 with the enclosed area 100 highlighted in a different color to further distinguish the enclosure, and the winning values of 20 102, 10 104, 30 106, and one special Cash Box symbol 110.

Figure 9:
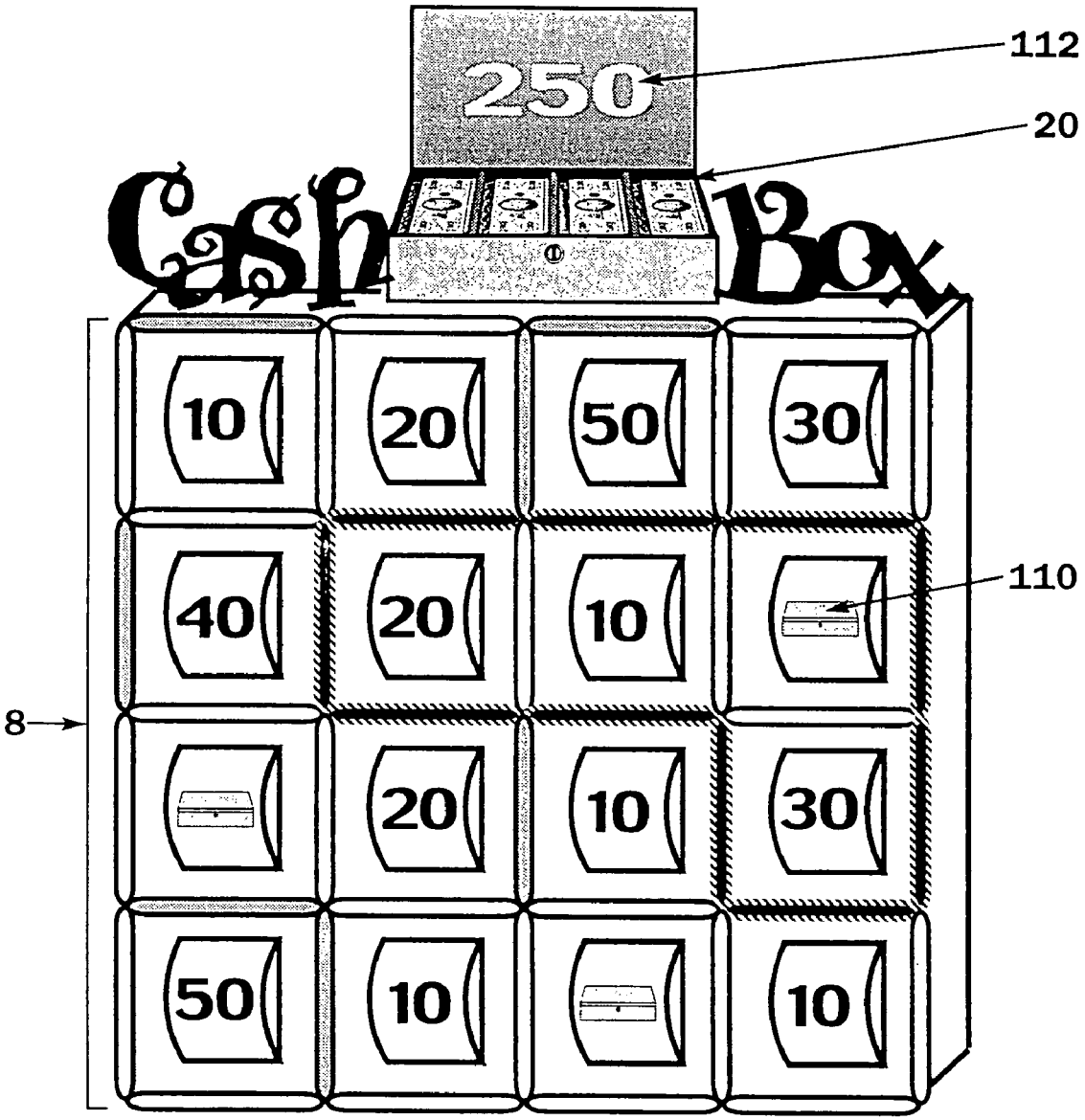
FIG. 9 shows the bonus top box game with the special Cash Box symbol triggering the physical Cash Box atop the machine to open and reveal a special bonus award of 250, for a total bonus win of 20+10+30+250, or 310.

FIG. 9 shows the bonus top box game 8 with the special Cash Box symbol 110 triggering the physical Cash Box 20 atop the machine to open and reveal a special bonus award 112 of 250, for a total bonus win of 20+10+30+250, or 310.

Figure 10:
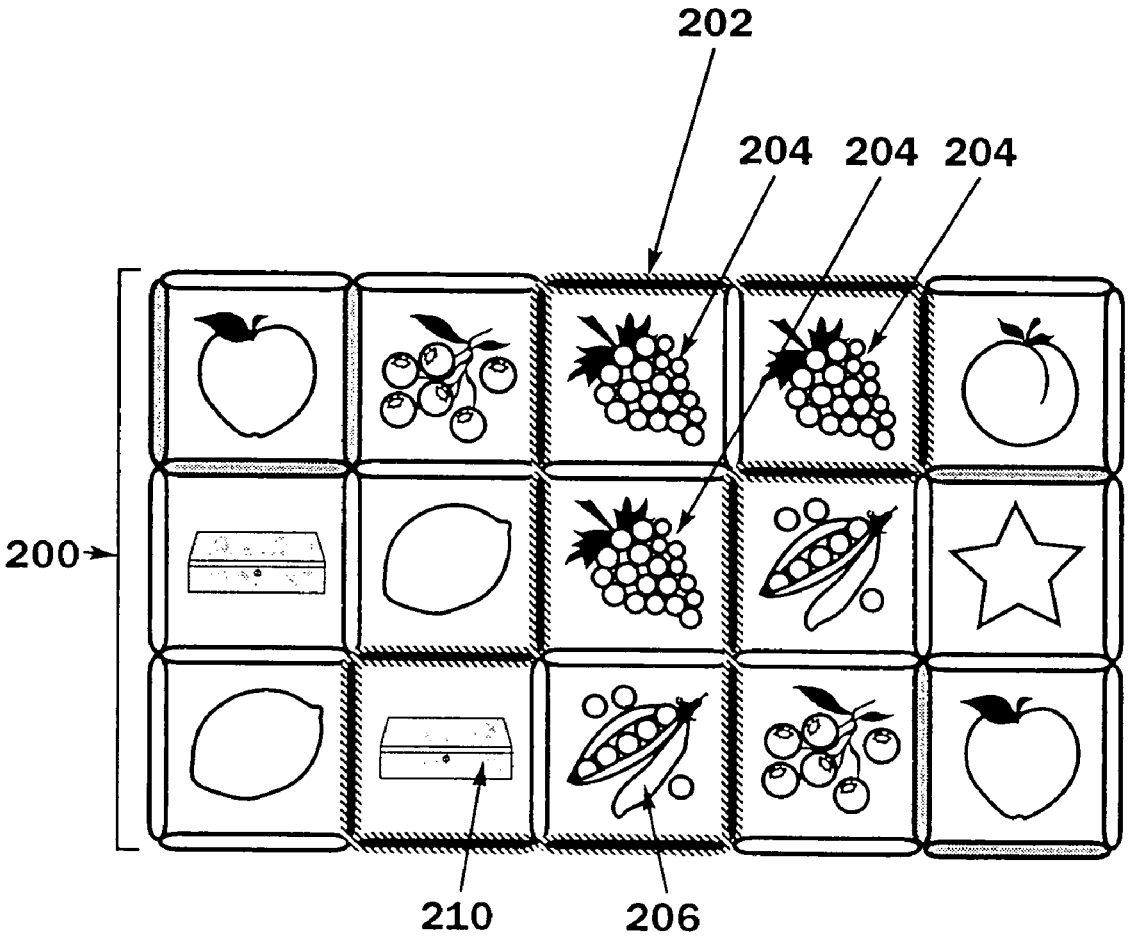
FIG. 10 shows the invention as used alternatively as a base game, with 5 reels having spun to reveal 15 symbols, a plurality of side segments having been "randomly" lighted, an enclosed area having been determined and highlighted, and the 3 grape symbols, one pea symbol, and one Cash Box symbol inside the enclosure awaiting award evaluation according to a predetermined pay table.

FIG. 10 shows an alternative base game format 200 using formats according to the bonus game (top box game) described above, with 5 reels having spun to reveal 15 symbols, a plurality of side segments having been "randomly" lighted, an enclosed area 202 having been determined and highlighted, and the 3 grape symbols 204, one pea symbol 206, and one Cash Box symbol 210 inside the enclosure 202 awaiting award evaluation according to a predetermined pay table.

Another format of play can also be seen according to the previous figures. Returning to FIGS. 1-7, assume that all squares are blank (or contain inactive symbols) and no active symbols have been shown. After an allotted number of edge features have been added to the blank areas, or after an enclosure has been defined according to the rules of play, the frame positions are spun or otherwise reconfigured to provide new symbols. Whatever symbols then appear within the enclosed area 100 will now be used in the determination of the award, bonuses and resolutions. Additionally, the edge features may be used to define areas considered for game play or bonus play according to other types of enclosing, as indicated before. As noted earlier, edge features 54 and 56 could be held according to game rules to have enclosed the value of 50, as it is impossible for that value (in that position) to be enclosed with any other values. Alternatively, as in FIG. 1A, if all of vertical line 38 were highlighted, the rules of the game could indicate that the values of 10, 30, 20 and 10 were enclosed. Further alternatively, in a methodology that defines more of a path (rather than a four sided enclosure), if vertical lines 38 and 36 were fully highlighted, the rules of the game could allow for the values of 20, 30, 40 and the cash box symbol to be considered enclosed to end play.

Another format of play could be to allow the game to place a specified (predetermined number) of edge features on the screen, for example, 16 edge features could be used in each play of the game (the number 16 is not magical out of the 40 edge features in the matrix shown) and be randomly assigned. If the random positioning of the 16 (or 17, 18, 19, 20, 21, 22, 23, 24, etc.) edge features encloses any symbols, then those symbols will be used in the analysis of winning and losing in the game or bonus game. If no symbols are enclosed, then there would be no award. The positioning of the edge features according to a predetermined number could be done before or after resetting the symbols in the play of a game.

Various aspects of the technology described herein comprises a method of playing a wagering game. A gaming display area is provided including game areas that may be indicated by placement of edge features (e.g., lines, pens, dashes, circles, points, highlighting, shading, etc.) as enclosed by the edge features. In the play of the game, the edge features are positioned on the gaming display area, as by random positioning or template positioning, as is known in the gaming art for reel mapping and random number definition and selection of symbols. The game ceases positioning of edge features according to rules of the wagering game to a final count of edge features. The final count may be selected by random number selection (e.g., selecting a specific number from within a set of numbers), by having a fixed number of edge features to be provided in any game (e.g., 16-28 edges on a 5×5 frame screen), by reaching a game ending determining result (e.g., some frames are completed, surround a symbol, or a path is completed that traverses from a starting point to a collectable symbol or reaches an icon indicative of a prize won). A processor then determines if the final count of edge features enclose symbols or reaches a collectable symbol or icon according to rules of the wagering game. The game rules then determine if any symbols enclosed by edge features or reached by a virtual pathway according to the rules of the game establish a winning event, losing event or push event in the game. The game areas may, by way on non-limiting examples, comprise symbols within a field (e.g., sheep on a field to be herded or penned, flowers on a field to be picked, bees on flowers to be surrounded by a basket, etc.). More typically, there will be initially areas that can be visually as distributed across the gaming display screen to provide game areas comprising symbols within frames (e.g., typical symbols within frames as shown by video slot games). The game areas would in that case often comprise symbols within quadrangular frames. The method may be performed where the final count of edge features is a randomly selected number of edge features, a randomly selected number of edge features, or a concluding event (e.g., at least 1, 2, 3, 4, 5, 6, 7, 8, etc. symbols are enclosed, or a path is created from a starting point to at least one (and possibly more) collectable symbols.

Another perspective of a method of playing a wagering game comprises providing a gaming display area including game areas that may be indicated as traversed by edge features to form a virtual pathway from one point on the gaming display area to a symbol at another point on the gaming display area. This would provide a display area that might initially or ultimately resemble a maze-type game where a player starts at one point at the beginning of the game, edge features are used to try to construct a path (e.g., by adding on edge feature or pairs of edge features, especially beginning at the starting point, until a game determined number of edge features are used, or until a virtual path is created to a collectable symbol. For example, a maze-forming grid may be provided with a bee as a starting point, and with various symbols such as flowers or bee hives distributed around the matrix on the gaming display area. When any path (one or more paths) is completed to one of the symbols, that symbol is accumulated by the player in the game. There may even be a game ending feature such as a bear that would indicate that the game ends at that point. This method could be played by positioning edge features on the gaming display area; ceasing positioning of edge features according to rules of the wagering game to a final count of edge features; determining if the final count of edge features enclose symbols according to rules of the wagering game and/or reach the symbol at the another point on the gaming display area; and determining if any symbols enclosed by edge features or reached according to the rules of the game establish a winning event, losing event or push event in the game. In the latter play method, the edge features could comprise parallel sets of edge features that ultimately define a pathway across the game display area.

The technology described herein also includes gaming apparatus that can comprise a game display area and a player input area. The apparatus might provide in the gaming display area game areas that may be indicated as enclosed (or traversed) by edge features. There would be a processor that is capable of providing edge feature indicators on the gaming display area. The processor can start and cease positioning of edge features according to rules of the wagering game to a final count of edge features. The processor may determine if the final count of edge features enclose symbols according to rules of the wagering game, and then the processor determines if any symbols enclosed or reached by edge features according to the rules of the game establish a winning event, losing event or push event in the game.

The traversal format of a game, as described above would be performed on a gaming apparatus comprising a game display area and a player input area. The apparatus providing in the gaming display area game areas that may be indicated as reached by a virtual path formed by edge features. There is again a processor that can provide virtual edge feature indicators on the gaming display area. The processor is also able to start and cease positioning of edge features according to rules of the wagering game to a final count of edge features. The processor determines if the final count of edge features reach collectable symbols according to rules of the wagering game; and the processor determines if any symbols reached by a virtual path according to the rules of the game establish a winning event, losing event or push event in the game. The use of traversal formats and enclosing formats also may be combined within a single game.

Standard computers, hardware, software, imaging and gaming technology can be used in the practice of the present invention. The game concepts described herein are not intended to be limited by the nature of the supporting technology which is well understood and commercially available to those skilled in the gaming art. Alternative subtleties of play within the general concepts described herein may also be used. For example, edge features do not have to be added one-at-a-time, but may be added in groups of 2's, 3's or more, or even in a single action, as by dropping "Pick-Up Stick™" game elements that would surround areas on the screen.

What is claimed:

1. A method of playing a wagering game comprising:

providing a gaming display area including game areas that may be indicated as enclosed by edge features;

displaying within each game area a symbol prior to positioning edge features;

randomly positioning edge features on the gaming display area;

ceasing positioning of edge features according to rules of the wagering game to a final count of edge features;

determining if the final count of edge features enclose symbols according to rules of the wagering game; and determining if any symbols are enclosed by edge features according to the rules of the game to establish a winning event, losing event, or push event in the game.

2. The method of claim 1 wherein the game areas comprise symbols within a field.

3. The method of claim 1 wherein the game areas comprise symbols within frames.

4. The method of claim 3 wherein the final count of edge features is a randomly selected number of edge features.

5. The method of claim 3 wherein the final count of edge features is a predetermined number of edge features.

6. The method of claim 1 wherein the game areas comprise symbols within quadrangular frames.

7. The method of claim 6 wherein the final count of edge features is a randomly selected number of edge features.

8. The method of claim 1 wherein the final count of edge features is a randomly selected number of edge features.

9. The method of claim 1 wherein the final count of edge features is a predetermined number of edge features.

10. A method of playing a wagering game comprising:

providing a gaming display area including game areas that may be indicated as traversed by edge features to form a virtual pathway from one point on the gaming display area to a symbol at another point on the gaming display area;

displaying within each game area a symbol prior to positioning edge features;

randomly positioning edge features on the gaming display area;

ceasing positioning of edge features according to rules of the wagering game to a final count of edge features;

determining if the final count of edge features enclose symbols on the gaming display according to rules of the wagering game; and determining if any symbols are enclosed by edge features according to the rules of the game to establish a winning event, losing event or push event in the game.

11. The method of claim 10 wherein the edge features comprise parallel sets of edge features that ultimately define a pathway across the game display area.

12. A gaming apparatus comprising:

a game display area and a player input area;

the apparatus providing in the gaming display area game areas that may be indicated as enclosed by edge features;

a processor configured to display within each game area a symbol prior to positioning edge features;

the processor randomly positioning edge feature indicators on the gaming display area;

the processor configured to start and cease positioning of edge features according to rules of the wagering game to a final count of edge features;

the processor determining if the final count of edge features enclose symbols according to rules of the wagering game; and the processor determining if any symbols are enclosed by edge features according to the rules of the game to establish a winning event, losing event or push event in the game.

13. A gaming apparatus comprising:

a game display area and a player input area;

the apparatus providing in the gaming display area game areas that may be indicated as enclosed by edge features of a virtual path formed by edge features;

a processor configured to display within each game area a symbol prior to providing virtual edge feature indicators;

the processor randomly providing virtual edge feature indicators on the gaming display area;

the processor configured to start and cease positioning of edge features according to rules of the wagering game to a final count of edge features;

the processor determining if the final count of edge features enclose symbols according to rules of the wagering game; and the processor determining if any symbols enclosed by edge features of the virtual path according to the rules of the game establish a winning event, losing event or push event in the game.

14. The gaming apparatus of claim 13 wherein the virtual path provides the appearance of a maze game traverse within the gaming display area from a starting point to a reached symbol.

* * * * *